US005527563A

United States Patent [19]

Unger et al.

[11] Patent Number: 5,527,563

[45] Date of Patent: Jun. 18, 1996

[54] FLOW COAT GALVANIZING

[75] Inventors: Carl H. Unger, Oak Lawn; Kalyan K. Maitra, Flossmoor, both of Ill.

[73] Assignee: Allied Tube & Conduit Corporation, Harvey, Ill.

[21] Appl. No.: 365,228

[22] Filed: Dec. 28, 1994

Related U.S. Application Data

[63] Continuation of Ser. No. 892,432, Jun. 10, 1992, abandoned, which is a continuation-in-part of Ser. No. 717,852, Jun. 25, 1991, abandoned.

[51] Int. Cl.[6] ..... B05D 1/18

[52] U.S. Cl. ..... 427/433; 427/434.2; 427/434.6; 427/434.7; 427/436; 118/405; 118/419; 118/DIG. 12

[58] Field of Search ..... 427/433, 434.2, 427/434.6, 434.7, 436; 118/419, 405, DIG. 12

[56] References Cited

U.S. PATENT DOCUMENTS

| | | | |
|---|---|---|---|
| 3,533,761 | 10/1970 | Pierson | 427/433 |
| 3,877,975 | 4/1975 | Raymond | 427/433 |
| 3,956,537 | 5/1976 | Raymond | 427/433 |
| 4,082,869 | 4/1978 | Raymond | 427/433 |
| 4,814,210 | 3/1989 | Ackermann et al. | 427/433 |

FOREIGN PATENT DOCUMENTS

| | | | |
|---|---|---|---|
| 91/11541 | 8/1991 | WIPO | 427/433 |

*Primary Examiner*—Shrive Beck
*Assistant Examiner*—Katherine A. Bareford
*Attorney, Agent, or Firm*—Banner & Allegretti, Ltd.

[57] ABSTRACT

This continuous galvanizing method and apparatus passes a linear element to be galvanized, e.g., wire, rod, or tube, through a surrounding, relatively short length of conduit which is attached as a cross-tee to the end of a delivery pipe rising from a centrifugal pump submerged in a vat of molten zinc, and continuously flooded with liquid zinc to coat the linear element. The zinc flowing from the open ends of the conduit, and falling as excess from the element being coated, drops back into the vat for recirculation. The vat is covered to provide a substantially closed operating space above the pool of molten zinc to enable the coating to take place in an inert atmosphere.

20 Claims, 3 Drawing Sheets

Fig. 5
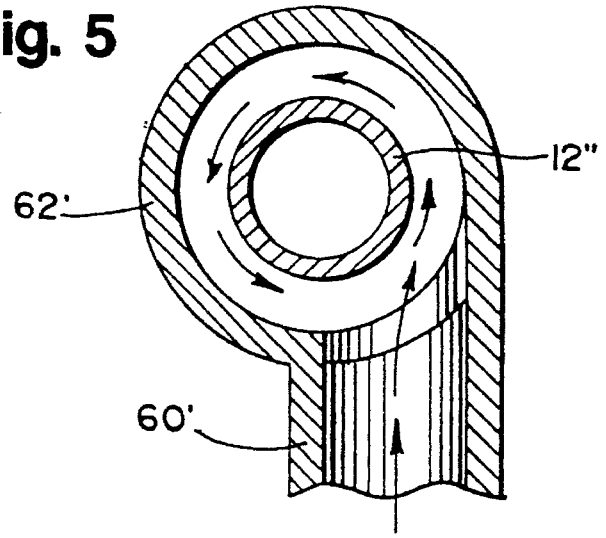
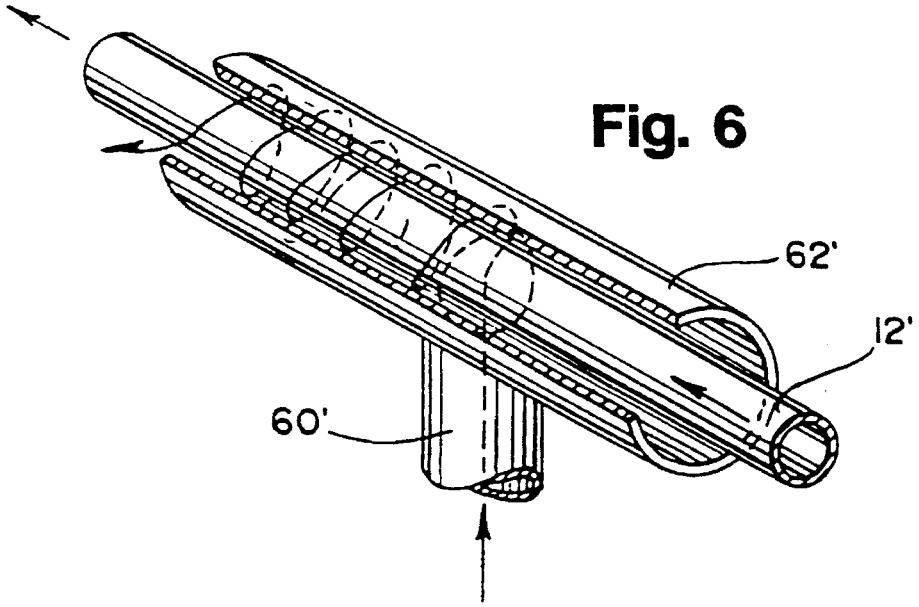
Fig. 6
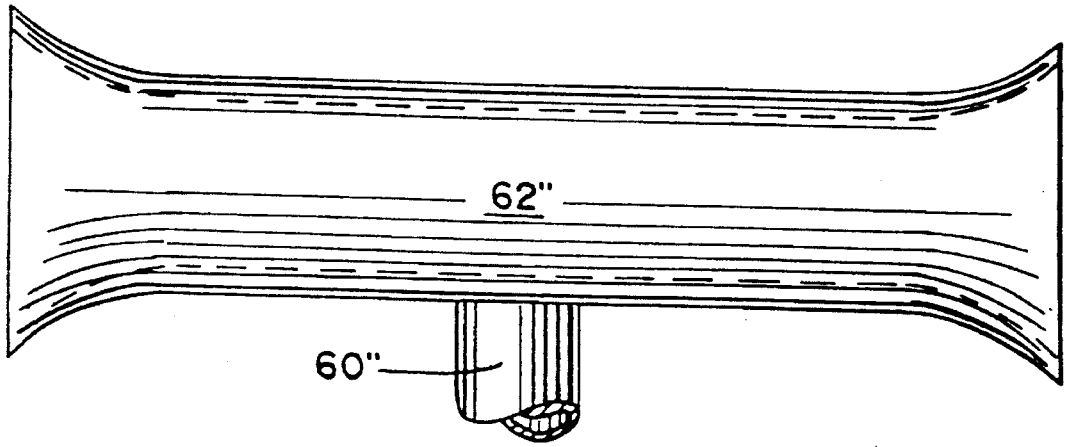
Fig. 7

FLOW COAT GALVANIZING

This is a continuation of application Ser. No. 07/892,432, filed on Jun. 10, 1992, now abandoned which is a continuation in part of application Ser. No. 07/717,852, filed Jun. 25, 1991, now abandoned.

This invention relates to a continuous process for galvanizing linear materials such as wire, rod, tube, or pipe, by immersing the axially moving linear element incrementally in molten zinc.

BACKGROUND OF THE INVENTION

The galvanization of the exterior surface of pipe or conduit as part of the continuous manufacture thereof from an endless strip of sheet metal has been practiced commercially for a number of years. The process basically consists of roll-forming the metal strip into tubular form after drawing it from an endless supply, welding the seam, scarfing and dressing off the weld, and passing the continuously formed tube through a pickling bath and rinse. The tube is then passed through a preheating station and then through a bath of molten zinc, after which the excess zinc is removed, the tube cooled to handling temperature in a water bath, and the tube sheared into finite lengths.

Such an integrated continuous manufacturing process is disclosed, for example, in U.S. Pat. No. 3,226,817, with particular emphasis on the galvanization step of the process in U.S. Pat. Nos. 3,226,817, 3,259,148 and 3,877,975.

In the galvanizing stations of such prior integrated processes, the continuously-formed, rapidly moving tube, after appropriate preparation, was passed through an elongated trough positioned above a pool of molten zinc in a large vat, from which a stream of the liquid metal was pumped to maintain a substantial and overflowing body of molten zinc in the trough as well as to replace the zinc being carried away from the trough as a fluid coating on the tube.

The amount of zinc pumped from the vat to the upper trough was substantial, and as those skilled in the art will appreciate, the formation of dross at the walls of the vat and the trough, and their consequent erosion due to the scouring action of the recirculating zinc, was likewise substantial. The accelerated erosion of the pump impeller and pump housing in this strenuous service required their replacement in days rather than weeks, but was regarded as a necessary maintenance burden to be tolerated as part of the continuous integrated manufacture of galvanized pipe and tube.

SUMMARY OF THE INVENTION

The present invention is based upon the discovery that effective galvanization does not require immersion of the traveling tube or pipe in the molten zinc for the length of time provided by the elongated upper trough of the prior art installations. Effective galvanization is accomplished by the method and apparatus of the invention by passing the tube or pipe through a flowing fountain of zinc confined by a T-section at the top of the delivery pipe of the pump. The traveling tube or pipe is thus surrounded by molten zinc drawn directly from the pool in the vat without transfer to a secondary pool in an immersion-trough positioned above the main pool in the vat. The reduction of the circulating amount of zinc permitted by this arrangement has greatly reduced the erosion of the pump parts and extended their useful life by an order of magnitude.

DESCRIPTION OF THE DRAWINGS

The invention is described in reference to the accompanying drawings, in which:

FIG. 5 is an enlarged end view of a T-head modified for tangential introduction of the stream of molten zinc;

FIG. 6 is an oblique projection of the T-head of FIG. 5, partly sectioned to expose the interior thereof and indicating diagrammatically the flow path of at least a portion of the molten zinc under operating conditions; and FIG. 7 is an elevational view of a further modification of the T-head of FIG. 1 or FIG. 6 with belled ends.

DESCRIPTION OF THE PREFERRED EMBODIMENTS

Figure 1:
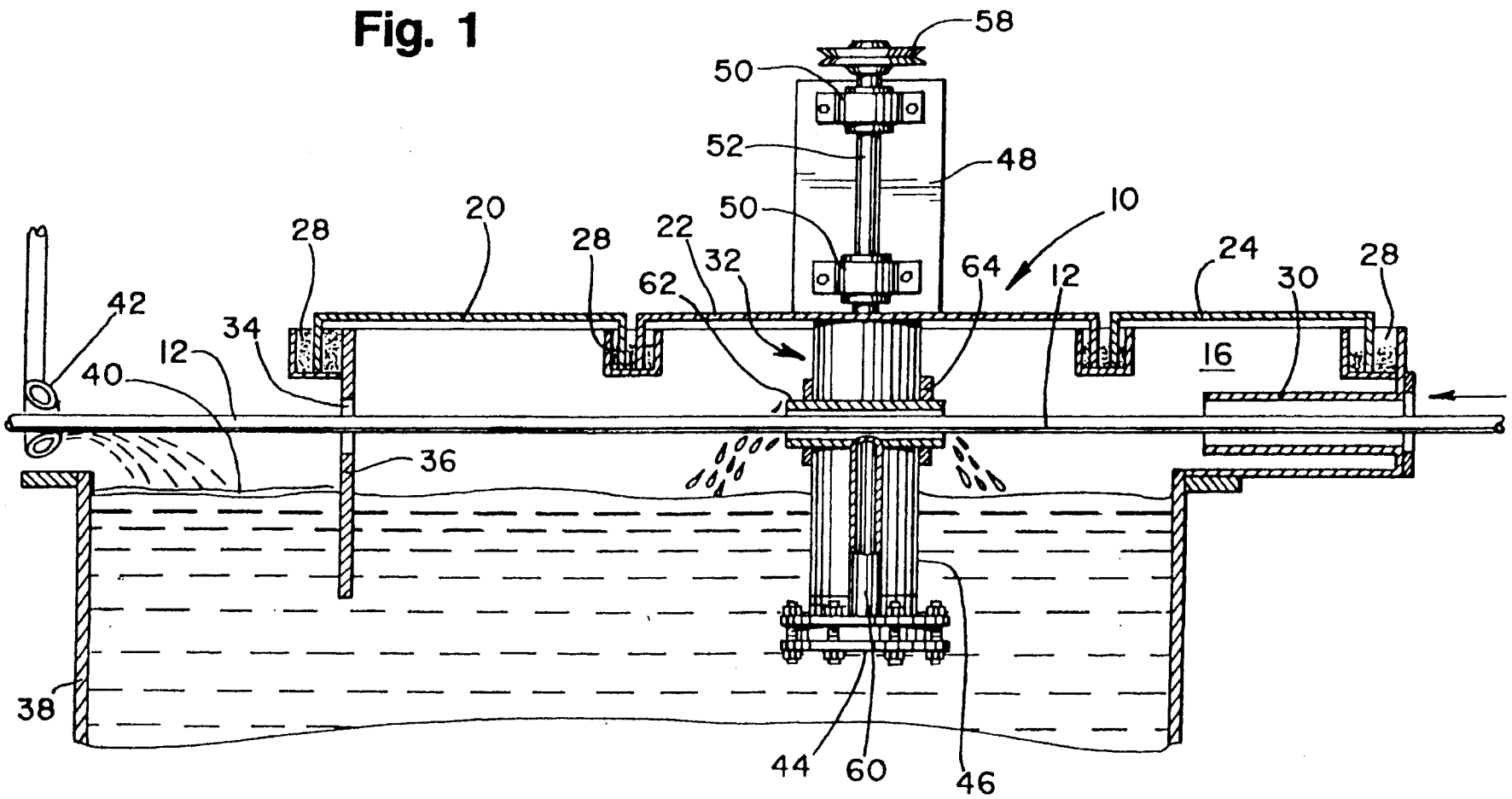
FIG. 1 is a diagrammatic, sectioned elevational view of galvanizing station in accordance with the invention, as installed in an integrated line for the continuous manufacture of galvanized steel tube or pipe.
Figure 2:
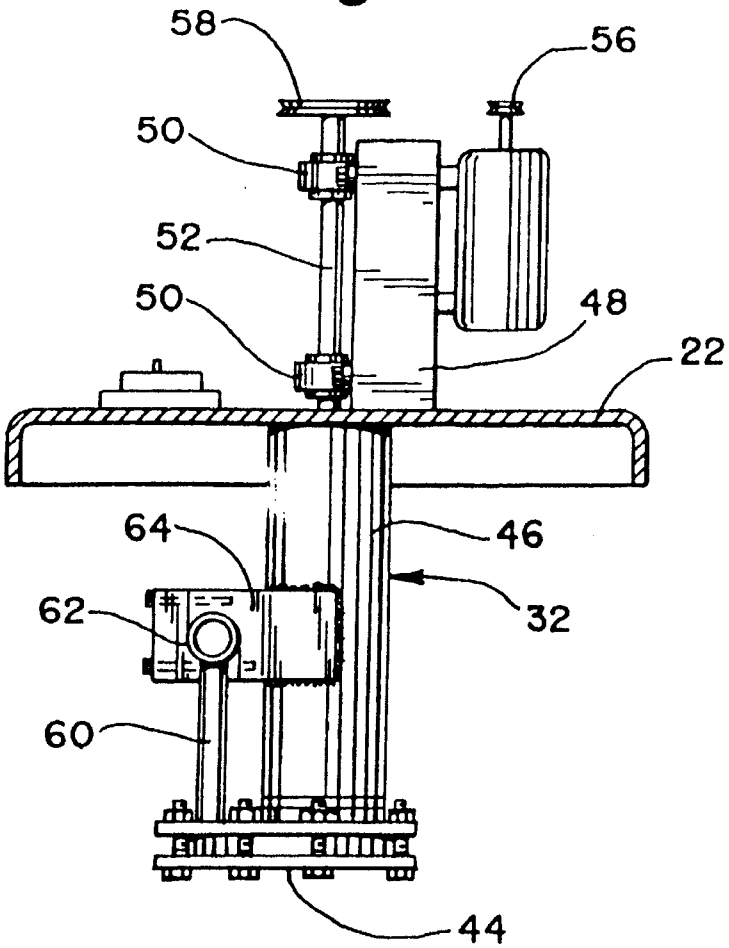
FIG. 2 is a diagrammatic end view of the submersible pump and galvanizing apparatus, lifted from the surrounding walls of the zinc vat.

Referring to FIGS. 1 and 2 for a general description of the method and apparatus of the invention, FIG. 1 shows galvanizing station 10 in an overall system for the continuous manufacture of galvanized pipe or conduit 12. While the method and apparatus illustrated were developed in the stated context, the invention is believed applicable to the continuous galvanization of other linear metal product such as wire or rod.

The conduit 12 passes through the galvanizing station from right to left as viewed in FIG. 1, delivered in rapid axial motion from a roll-forming station where an endless band of metal is progressively rolled into tubular form with abutting edges which are closed by an electrically welded seam which is scarfed and dressed en route to the galvanizing station. In preparation for galvanizing, which is essentially total immersion of the conduit 12 in molten zinc, the conduit is first cleaned by a pickling bath of acid, followed by a neutralizing rinse, after which the tube is preheated immediately before entry into the galvanizing station. Preheating is conveniently accomplished by passing the conduit axially through an induction heating coil. As these pregalvanizing steps are well understood in the art, they are not here shown, reference simply being made to the Krengel U.S. Pat. No. 3,259,148, in which one such system is illustrated and described.

The galvanizing station 10 is essentially an elongated vat 14 of molten zinc constructed in generally rectangular form of welded steel plate and formed to provide a space 16 above the predetermined level of the pool 18 of liquid zinc therein, maintained in molten condition at about 850° F., i.e., about 100° F. above the melting point of zinc. The heating means, not shown, may be gas or oil burners directed against the bottom of the vat.

The space 16 above the pool of liquid zinc is closed by a series of covers 20, 22, and 24 having downwardly extending perimeter flanges 26 which are received in troughs 28 extending around the periphery of the vat and transversely of the vat, as well, to permit the use of multiple covers for convenient access to the interior of the vat for maintenance purposes. The troughs 28 in which the cover flanges are received are partially filled with a granular material, such as sand, which forms a barrier to the escape of the inert gas with which the space 16 above the molten zinc is filled and maintained slightly above atmospheric pressure to prevent, or at least limit, the entry of air into that space.

As earlier noted, the conduit 12 enters the galvanizing station from the right immediately from the preheater, the housing for which is normally abutted against the entering end of the galvanizing station with an intervening packing of mineral wool or the like to limit the entrainment of ambient air into the galvanizing zone above the molten metal. The conduit enters the station 10 through a hole in the vat wall and thence through a larger tube 30 intended to bring the conduit into more intimate contact with the inert purging gas. The tube then passes through the galvanizing apparatus 32 of the invention and exits the galvanizing zone through an aligned hole 34 in the far wall 36 of the space.

It will be noted that the far wall 36 of the space is positioned above and extends downwardly into the pool 18 of molten zinc at some distance removed from the end wall 38 of the vat proper, providing a small area 40 of open access to the pool of zinc through which the inventory of molten zinc is maintained by the periodic addition of pigs of the metal. That open area also serves the further purpose of receiving the molten zinc trimmed from the outer surface of the conduit 12 by an air knife 42 which consists of a series of nozzles in an annular manifold directed to deliver a cutting stream of compressed air onto the surface of the conduit to trim the excess zinc therefrom, propelling the same in a flat trajectory onto the exposed area 40 of the pool of molten zinc.

In such a manufacturing line, the workpiece conduit 12 travels at a good rate of speed, not infrequently in excess of 600 feet per minute.

The galvanizing apparatus 32 per se is shown mounted on the central vat cover 22. It comprises essentially a submersible centrifugal pump 44 secured as by welding to the lower end of a thick-walled mounting pipe 46 welded to the underside of the vat cover. Supporting structure 48 mounted on the upper side of the cover 22 provides two bearings 50 for the vertical shaft 52 of the pump, which is driven at its upper end from a variable speed, vertical electric motor 54 by a V-belt entrained on a pair of speed-reducing pulleys 56 and 58. At its lower end, there is keyed onto the shaft 52 a double-sided pump impeller (not shown) which when rotating draws the molten zinc from the pool through a central intake in the bottom plate of the pump and a similar central hole in the top plate of the pump, through which the shaft 52 passes with wide clearance to admit the zinc to the upper impeller blades. Access by the liquid zinc to the upper central opening is provided by ports in the supporting structure between the upper plate of the pump and the mounting pipe 46. The mounting pipe 46 completely shrouds the pump shaft from the inert gas in the space 16, eliminating the need for shaft seals between the shaft 52 and cover 22 to prevent the escape of the gas.

The pump delivers the molten zinc to a riser pipe 60 which carries the liquid metal upwardly to a T-head 62 in the form of an open tube aligned to receive the rapidly moving conduit 12 axially therethrough. To support the T-head firmly, a pair of brackets 64, welded to the mounting pipe 46 of the pump, encircle the T-head 62 in a split-block configuration in which the two parts of each bracket are secured together by screws to maintain the T-head firmly in position.

The variable speed pump 44 is driven at a speed adequate to deliver a constant upward flow of molten zinc sufficient to surround the conduit traveling through the T-head 62, which, in contrast with the trough type of galvanizing apparatus heretofore employed, may be relatively short, i.e., of the order of 20 inches, with the excess zinc spilling from the ends of the T-head to fall directly into the pool from which it was pumped, it being noted that the surface of the pool 18 beneath the confined, nitrogen-filled space is free from the frothy oxide layer at the uncovered left-hand end of the vat.

While the invention as specifically illustrated in FIGS. 1 and 2 employs to advantage the submersible centrifugal pump 44, the invention in its broader aspects is not dependent upon a specific form of pump. Other kinds of pumps, for example, non-contact electromagnetic pumps, may also be employed, although preferably with suitable provision for the variable delivery rate achieved by speed control of the mechanical pump illustrated.

Figure 3:
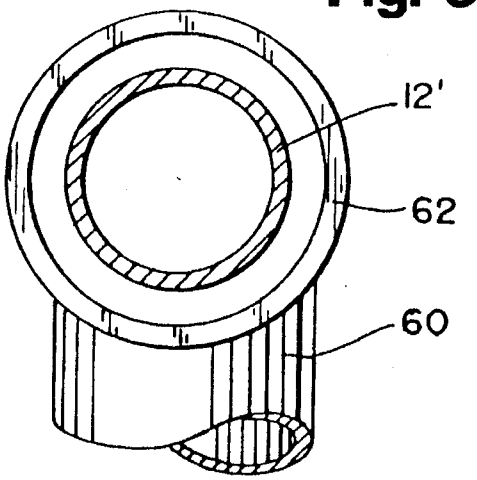
FIGS. 3 and 4 are enlarged end views of the T-head of the galvanizing apparatus, atop the riser pipe from the pump, showing the relationship of the flow-confining T-head to different diameters of tube or pipe passing through the T-head.
Figure 4:
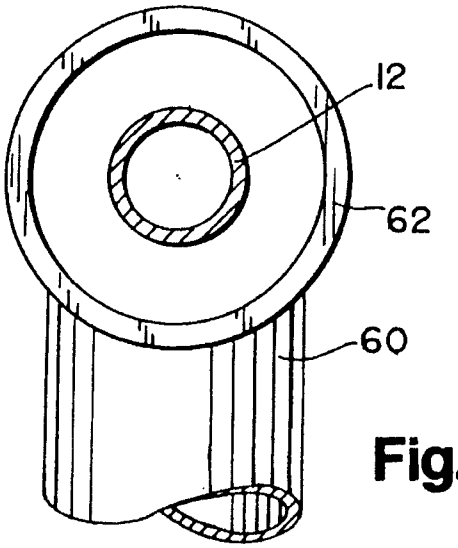

In one apparatus of the illustrated kind, the cross-head of the T has an inside diameter of 2⅞ inches, and has been used successfully in the illustrated setup to galvanize pipe up to 2.197 inches in outside diameter, i.e., nominal two-inch tin wall electrical conduit, and down to 0.706 inch O.D., i.e., nominal half-inch thin wall conduit for electrical wiring. As will be apparent from FIGS. 3 and 4, different sizes of tube, pipe, or conduit to be galvanized require the pumping of varying amounts of zinc to completely immerse the traveling workpiece on its passage through the T-head, a larger amount of zinc being required for smaller tube in a cross-head of given size, particularly as it is preferred to pump the zinc at a rate sufficient to flood the annular space between the traveling workpiece and the surrounding T-head for at least a portion of the length of the T-Head. The pumping requirements, however, are much reduced from those of the prior art galvanizing apparatus such as illustrated by Krengel U.S. Pat. No. 3,259,148, because the pumping of zinc in quantity sufficient to maintain the molten metal in a separate sizable trough above the pool of zinc is not required by the illustrated apparatus, the pressure head to which the zinc must be pumped is reduced, and the galvanizing process may be carried on with less recirculation of the molten metal.

These differences result in very significant benefits.

First, a very noticeable reduction in the erosion of the pumps has been experienced. Whereas pump life had heretofore ranged from one to three days depending upon severity of service, the reduced pumping requirements of the present invention have increased pump life to in excess of thirty days, an order of magnitude improvement.

Secondly, elimination of the upper immersion trough, and the reduction of the recirculating currents in the molten metal at the lower pumping requirements of the apparatus of the invention, have resulted in a noticeable reduction of the formation of dross, and consequent longer life for the steel walls of the zinc vat. Moreover, while not yet realized in existing zinc vats, it is apparent that without the necessity for maintaining an elongated upper galvanizing trough separate from the main body of molten zinc in the vat, the vat itself can be downsized by approximately one-half, which will effect further economies of maintenance to the zinc vat and at the same time reduce the amount of energy required to maintain the constant inventory of molten zinc.

Lastly, the invention has made possible a significant reduction in the amount of scrap generated on start-up, with concomitant improvement in manufacturing safety, and reduced the time required to switch the line from galvanized to non-galvanized manufacture. As to scrap generation, each time the roll-stands of the roll-forming station are changed to set the line up to make a different size of pipe or conduit, adjustments at the roll-forming, and sometimes the welding, stations are usually required before an acceptable seam-closing weld is achieved. Only then is it safe to begin galvanizing, for to pass a zinc-filled, open-seam tube into the cooling bath at the temperature and heat energy levels involved is to invite explosion by flash-vaporizing the cooling water.

To avoid this danger, the line must be run until an acceptable seam is produced before galvanizing may proceed. In the upper trough and lower vat combination, a not insignificant further amount of time was required to bring the zinc in the upper trough up to the overflow level to produce acceptable product. This in turn resulted in the production of scrap even after an acceptably welded seam was produced.

In the apparatus of the invention, the short lift of the molten zinc from the pool 18 to the cross-head 62 at the top of the riser pipe 60 results in the almost instantaneous production of quality product with little or no scrap of galvanized conduit incident to start-up. The rapid emptying as well as refilling of the riser pipe 60 and cross-head 62, moreover, has reduced changeover of the line from galvanized to non-galvanized manufacture, and vice versa, to simply turning the pump motor off or on, and, either way, results in almost negligible scrap with substantially instantaneous changeover.

In the modified form of the galvanizing apparatus of this invention shown in FIG. 5, the riser pipe 60' merges off center with the open-ended tubular cross-head of the T-head 62' so that the in-flowing stream of molten zinc enters the cross-head transversely and eccentrically of the tubular cross-head, i.e., tangentially where the cross-head 62' is a round tube, to wrap the through-passing conduit 12' with the tangentially flowing stream of zinc.

Given that the conduit 12' is itself passing axially through the cross-head 62' at speeds of up to 600 feet per minute, the adherence of the zinc to the rapidly moving workpiece applies a force to the molten zinc in the direction of the workpiece flow, from right to left in FIG. 6, resulting in the helical wrap of workpiece by the flowing zinc. This flow pattern is illustrated in oversimplified and diagrammatic form in FIG. 6. Actually, because the tubular cross-head 62' is open at both ends without restriction, other than the through-passing workpiece conduit 12' itself, there is some back flow of molten zinc to the entering end of the cross-head, from which the molten zinc falls to the surface of the pool in the vat.

The greater overflow of zinc occurs at the exiting end of the cross-head, and when that overflow is at its greatest, i.e., at the higher pumping rates employed for smaller size workpiece conduit, the overflow stream may project a substantial distance from the end of the cross-head, in the absence of provision for reducing the velocity of the overflowing zinc. Such provision can conveniently be made, as shown in FIG. 7, by belling out the ends of the cross-head 62" to increase the cross-sectional area of the cross-head to reduce the velocity, and shorten the trajectory of the streams from the ends of the cross-head.

The features of the invention believed new and patentable are set forth in the accompanying claims.

What is claimed is:

1. In a continuous process for galvanizing linear elements, an improved method of applying molten zinc to a cleansed and preheated linear element to be galvanized comprising:

passing the linear element axially through a horizontal open-ended tube having ends of interior cross-sectional area at least as great as any other interior cross-section of said tube and interior cross-sectional dimensions greater than the exterior cross-sectional dimensions of said linear element so as to provide a clearance space between said linear element and the interior walls of said tube;

coating the linear element with molten zinc by pumping molten zinc in a continuous stream directly into the underside of said open-ended tube intermediate its ends from a pool of molten zinc beneath said open-ended tube at a rate sufficient to immerse the linear element in flowing molten zinc as it passes through said open-ended tube and to overflow from the ends of the tube and at a rate sufficient to flood the space between said linear element and the interior walls of said tube for at least a portion of the length of said tube; and collecting by gravity the zinc flowing from the ends of said open-ended tube and dripping from the coated linear element.

2. The method of claim 1 wherein the flow rate of the zinc pumped into the open-ended tube is adjustable to flooding requirements of linear elements of different cross-sectional size.

3. The method of claim 1 wherein the stream of molten zinc is introduced into said open-ended tube transversely and eccentrically thereof.

4. The method of claim 3 wherein the open-ended tube has a circular cross-section, the stream of molten zinc is introduced into the tube tangentially of its cross-section and is drawn into a helical flow pattern by the frictional drag of the through-passing linear element.

5. In a continuous process for galvanizing metal conduit having an outer surface, a method of applying molten zinc to a cleansed and preheated metal conduit to be galvanized comprising:

rolling a band of metal into tubular form with abutting edges;

welding the abutting edges to form said conduit;

cleaning said conduit with acid;

rinsing said conduit;

preheating said conduit in an inert atmosphere;

providing a source of molten zinc;

providing an inert gaseous environment over said source;

passing said conduit through an application zone in an inert atmosphere; and pumping a stream of molten zinc from said source around said conduit so that each point on said conduit's outer surface makes contact with said stream for 0.167 second or less, whereby said conduit is coated with molten zinc and is galvanized.

6. A process, as claimed in claim 5, wherein said application zone has a length of 20 inches or less and said conduit is passed through said application zone at a speed of at least 600 feet per minute.

7. A process, as claimed in claim 5, wherein said zone can accommodate metal conduits of different thicknesses from a maximum thickness to a minimum thickness and wherein a ratio of the volume of molten zinc in said zone to a volume of said maximum thickness of said conduit in said zone is 0.3086 or less.

8. A process, as claimed in claim 5, wherein said step of causing a stream of molten zinc from said source to flow through said application zone comprises the step of pumping said stream of zinc to said conduit in a continuous stream.

9. A process, as claimed in claim 5, wherein said step of causing a stream of molten zinc from said source to flow through said application zone comprises the step of confining a portion of said stream to an area surrounding said conduit as said conduit is passing through said zone.

10. A process, as claimed in claim 9, wherein said step of confining comprises the step of placing said stream in contact with said conduit transversely and eccentrically with respect to said conduit.

11. A process, as claimed in claim 10, wherein the step of placing comprises the step of introducing said stream to said zone tangentially of the cross-section of said conduit so that the stream is drawn into a helical flow pattern around said conduit.

12. A method of galvanizing a linear element composed of a ferrous metal by means of a pump, said method comprising:

providing an upwardly open reservoir of molten zinc;

maintaining an atmosphere of inert gas within an enclosed space above the surface of the molten zinc in said reservoir;

heating the linear element to be galvanized to a temperature at least as great as that of the molten zinc;

driving said heated linear element axially through an application zone located above said surface in said enclosed space;

pumping under pressure a stream of said molten zinc from said reservoir to a position at one side of said linear element adjacent said application zone, said stream having a delivery rate determined at least in part by the speed of said pump;

projecting said stream under pressure from said pump from said position through said application zone around the entire circumference of said linear element in quantity exceeding that which will adhere to said linear element, said stream requiring no heating to remain molten from the time of departure from said reservoir to the time of return to said reservoir;

adjusting said delivery rate of said stream projected under pressure from said pump through said application zone: and allowing the excess and unadhered molten zinc to fall from said linear element onto the surface of the molten zinc in said reservoir, whereby said linear element is coated with zinc without requiring heating of said stream in said inert atmosphere and said excess and said unadhered molten zinc is returned to said reservoir.

13. A method, as claimed in claim 12, wherein the step of pumping comprises the step of surrounding said circumference for a distance of 20 inches or less along said circumference.

14. A method, as claimed in claim 13, wherein the step of moving said linear element comprises the step of moving said linear element at a rate of at least 600 feet per minute.

15. A method, as claimed in claim 12, wherein the step of pumping comprising the step of pumping said stream through a horizontal open-ended tube having ends of interior cross-sectional area at least as great as any other interior cross-section of said tube and interior cross-sectional dimensions greater than the exterior cross-sectional dimensions of said linear element so as to provide a clearance space between said linear element and the interior walls of said tube.

16. A method, as claimed in claim 15, wherein said tube has a length of 20 inches or less.

17. A method, as claimed in claim 15, wherein the step of pumping comprises the step of pumping said stream into an underside of said open-ended tube intermediate the ends of said open-ended tube.

18. A method, as claimed in 15, wherein the flow rate of the zinc pumped into said open-ended tube is adjustable to flooding requirements of linear elements of different cross-sectional size.

19. A method, as claimed in claim 15, wherein said stream of molten zinc is introduced into said open-ended tube transversely and eccentrically thereof.

20. A method, as claimed in claim 19, wherein said open-ended tube has a circular cross-section, and wherein said stream of molten zinc is introduced into said tube tangentially of the cross-section of said tube to cause a helical flow pattern.

* * * * *